US012012820B2

(12) United States Patent
Cheng

(10) Patent No.: US 12,012,820 B2
(45) Date of Patent: Jun. 18, 2024

(54) SYSTEM AND METHOD FOR HANGER WITH DEBRIS POCKET

(71) Applicant: Baker Hughes Oilfield Operations LLC, Houston, TX (US)

(72) Inventor: Samuel Cheng, Katy, TX (US)

(73) Assignee: Baker Hughes Oilfield Operations LLC, Houston, TX (US)

( * ) Notice: Subject to any disclaimer, the term of this patent is extended or adjusted under 35 U.S.C. 154(b) by 53 days.

(21) Appl. No.: 17/579,979

(22) Filed: Jan. 20, 2022

(65) Prior Publication Data

US 2023/0228165 A1 Jul. 20, 2023

(51) Int. Cl.
*E21B 33/043* (2006.01)
*E21B 23/06* (2006.01)
*E21B 33/14* (2006.01)

(52) U.S. Cl.
CPC ..... *E21B 33/043* (2013.01); *E21B 23/06* (2013.01); *E21B 33/143* (2013.01)

(58) Field of Classification Search
CPC ..... E21B 33/043; E21B 23/06; E21B 33/143
See application file for complete search history.

(56) References Cited

U.S. PATENT DOCUMENTS 3,587,733 A * 6/1971 Miller ..... E21B 33/043 166/301
3,885,625 A 5/1975 Ahlstone
4,815,770 A * 3/1989 Hyne ..... E21B 33/043 285/915
5,456,321 A * 10/1995 Shiach ..... E21B 33/04 166/387
6,202,745 B1 * 3/2001 Reimert ..... E21B 33/04 166/208
7,213,657 B2 5/2007 Vold
7,762,319 B2 * 7/2010 Nelson ..... E21B 33/04 166/88.1
9,334,714 B2 5/2016 Stromquist
10,907,428 B2 2/2021 Luke
2004/0221984 A1 11/2004 Cram
(Continued)

FOREIGN PATENT DOCUMENTS

WO 2017/210112 12/2017

OTHER PUBLICATIONS

Trimble et al., "Fundamentals of mechanical debris management," Apr. 12, 2011, American Association of Drilling Engineers AADE-11-NTCE-5, p. 1-8.

(Continued)

*Primary Examiner* — Steven A MacDonald
(74) *Attorney, Agent, or Firm* — Hogan Lovells US LLP

(57) ABSTRACT

A wellbore system includes a lock ring forming at least a portion of a sealing assembly, the lock ring being coupled to and axially lower than one or more components of the sealing assembly to be positioned within an annulus. The wellbore system also includes a pedestal coupled to the lock ring, the pedestal arranged axially lower than at least a portion of the lock ring, the pedestal to be installed within the annulus. The wellbore system further includes a shoulder formed on at least a portion of a hanger. The wellbore system also includes a debris pocket formed within the annulus, the debris pocket arranged axially lower than both the shoulder and a lock ring groove.

19 Claims, 8 Drawing Sheets

(56) References Cited

U.S. PATENT DOCUMENTS

| | | | | |
|---|---|---|---|---|
| 2010/0147533 | A1* | 6/2010 | Nelson | E21B 33/04 166/75.13 |
| 2010/0193195 | A1* | 8/2010 | Nguyen | E21B 33/04 166/338 |
| 2013/0140042 | A1* | 6/2013 | Benson | E21B 33/0422 166/387 |
| 2013/0146306 | A1 | 6/2013 | Yates | |
| 2014/0076573 | A1 | 3/2014 | Gette | |
| 2014/0069631 | A1 | 4/2014 | Gette | |
| 2015/0068725 | A1* | 3/2015 | Duong | E21B 33/04 166/75.14 |
| 2015/0114667 | A1* | 4/2015 | Mansukh | E21B 33/04 166/381 |
| 2015/0114668 | A1* | 4/2015 | Mansukh | E21B 33/043 166/77.51 |
| 2015/0136426 | A1* | 5/2015 | Nguyen | E21B 33/03 166/382 |
| 2016/0145960 | A1 | 5/2016 | Gadre | |
| 2016/0245040 | A1* | 8/2016 | Nelson | E21B 33/038 |
| 2018/0179838 | A1* | 6/2018 | Nguyen | E21B 33/04 |

OTHER PUBLICATIONS

Seng Choon K et al., "New wellhead design and speeds up operations," Oct. 2016, Hart Energy, 2 pages.

International Search Report and Written Opinion dated May 3, 2023 in corresponding PCT Application No. PCT/US2023/060651.

* cited by examiner

SYSTEM AND METHOD FOR HANGER WITH DEBRIS POCKET

BACKGROUND

1. Field of the Disclosure

The present disclosure relates to wellbore operations. Specifically, the present disclosure relates to systems and methods for sealing and hanging components in a downhole environment.

2. Description of Related Art

Oil and gas operations may be conducted in a variety of environments, such as subsea or surface environments, where components are installed on a rig or sea floor. Certain downhole components may be arranged within a wellbore and then used for several different operations, such as a drilling operation that may be followed by cementing operations, cleaning and flushing operations, installation of additional components, and others. These various operations may lead to debris in the wellbore, such as debris from a drilling or cutting operation, where fluids may be injected to carry the debris out of the wellbore via an annulus. However, debris may be suspended and eventually fall and land near component interfaces, such as sealing surfaces, which may cause problems with later operations, such as landing and expansion of downhole seals.

SUMMARY

Applicants recognized the problems noted above herein and conceived and developed embodiments of systems and methods, according to the present disclosure, for wellbore operations.

In an embodiment, a wellbore system includes a lock ring forming at least a portion of a sealing assembly, the lock ring being coupled to one or more segments of the sealing assembly to be positioned within an annulus between a hanger and a housing. The wellbore system also includes a pedestal coupled to the lock ring, the pedestal arranged axially lower than at least a portion of the lock ring, the pedestal to be installed within the annulus along with the lock ring. The wellbore system further includes a shoulder formed on at least a portion of the hanger, the shoulder positioned to receive the pedestal. The wellbore system also includes a debris pocket formed within the annulus, the debris pocket arranged axially lower than both the shoulder and a lock ring groove.

In an embodiment, a wellbore system, includes a lock ring forming at least a portion of a sealing assembly, the lock ring being coupled axially lower than one or more components of the sealing assembly to be positioned within an annulus between a hanger and a housing. The wellbore system also includes a pedestal coupled to the lock ring, the pedestal arranged axially lower than at least a portion of the lock ring, the pedestal to be installed within the annulus along with the lock ring. The wellbore system further includes a shoulder formed on at least a portion of the hanger, the shoulder positioned to receive the pedestal. The wellbore system includes a debris pocket formed within the annulus, the debris pocket arranged axially lower than both the shoulder and a lock ring groove.

In another embodiment, a wellbore system includes a housing having a lock ring groove and a hanger arranged coaxially within the housing, the hanger having an auxiliary shoulder positioned axially lower than at least a portion of the lock ring groove. The wellbore system also includes a sealing assembly. The sealing assembly includes a sealing element to be positioned between the housing and the hanger and an energizing element, the energizing element to drive the sealing element between an energized position and unenergized position. The wellbore system further includes a lock ring coupled to at least one of the sealing element or the energizing element, the lock ring to move radially toward the lock ring groove to secure the hanger in the wellbore. The wellbore system also includes a pedestal coupled to the lock ring, a bottom surface of the pedestal being axially lower than the lock ring such that the pedestal is positioned between the lock ring and the auxiliary shoulder when the lock ring is installed. The wellbore system includes a debris pocket formed between the hanger and the housing, the debris pocket being axially lower than the lock ring groove and the auxiliary shoulder.

A wellbore system includes a housing having a lock ring groove and a hanger arranged coaxially within the housing, the hanger having an auxiliary shoulder positioned axially lower than at least a portion of the lock ring groove. The wellbore system also includes a sealing assembly that includes a sealing element to be positioned between the housing and the hanger and an energizing element, the energizing element to drive legs of the sealing element into at least one of the housing or the hanger. The wellbore system also includes a lock ring coupled to and axially lower than at least one of the sealing element or the energizing element, the lock ring to move radially toward the lock ring groove to secure the hanger in an energized position. The wellbore system further includes a pedestal coupled to the lock ring, a bottom surface of the pedestal being axially lower than the lock ring such that the pedestal is positioned between the lock ring and the auxiliary shoulder when the lock ring is installed. The wellbore system includes a debris pocket formed between the hanger and the housing, the debris pocket being axially lower than the lock ring groove and the auxiliary shoulder.

In an embodiment, a method includes providing a hanger having an auxiliary shoulder, the auxiliary shoulder having a larger outer diameter than a sealing neck of the hanger. The method also includes positioning the hanger within a housing such that the auxiliary shoulder is axially lower than at least a load bearing portion of a lock ring groove. The method further includes running a sealing assembly into an annulus between the hanger and housing, the sealing assembly including a lock ring and a pedestal. The method also includes positioning the pedestal on the auxiliary shoulder, the pedestal reducing an opening area for a debris pocket formed axially lower than the auxiliary shoulder. The method further includes energizing the sealing assembly such that the lock ring is driven into the lock ring groove.

BRIEF DESCRIPTION OF DRAWINGS

The foregoing aspects, features, and advantages of the present disclosure will be further appreciated when considered with reference to the following description of embodiments and accompanying drawings. In describing the embodiments of the disclosure illustrated in the appended drawings, specific terminology will be used for the sake of clarity. However, the disclosure is not intended to be limited to the specific terms used, and it is to be understood that each specific term includes equivalents that operate in a similar manner to accomplish a similar purpose.

DETAILED DESCRIPTION

Figure 1:
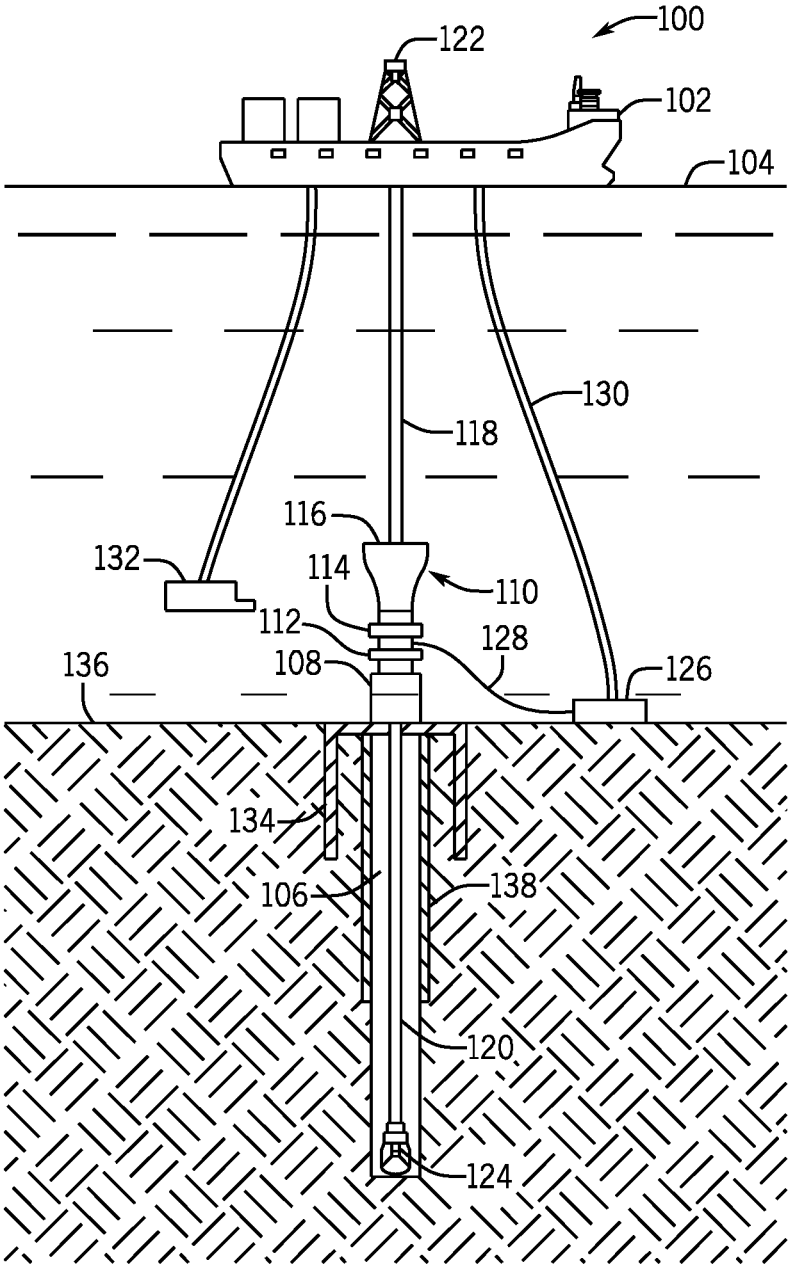
FIG. 1 is a schematic side view of an embodiment of an offshore drilling operation, in accordance with embodiments of the present disclosure.

The foregoing aspects, features, and advantages of the present disclosure will be further appreciated when considered with reference to the following description of embodiments and accompanying drawings. In describing the embodiments of the disclosure illustrated in the appended drawings, specific terminology will be used for the sake of clarity. However, the disclosure is not intended to be limited to the specific terms used, and it is to be understood that each specific term includes equivalents that operate in a similar manner to accomplish a similar purpose.

When introducing elements of various embodiments of the present disclosure, the articles "a", "an", "the", and "said" are intended to mean that there are one or more of the elements. The terms "comprising", "including", and "having" are intended to be inclusive and mean that there may be additional elements other than the listed elements. Any examples of operating parameters and/or environmental conditions are not exclusive of other parameters/conditions of the disclosed embodiments. Additionally, it should be understood that references to "one embodiment", "an embodiment", "certain embodiments", or "other embodiments" of the present disclosure are not intended to be interpreted as excluding the existence of additional embodiments that also incorporate the recited features. Furthermore, reference to terms such as "above", "below", "upper", "lower", "side", "front", "back", or other terms regarding orientation or direction are made with reference to the illustrated embodiments and are not intended to be limiting or exclude other orientations or directions. It should be further appreciated that terms such as approximately or substantially may indicate +/−10 percent.

Embodiments of the present disclosure are directed toward systems and methods to land a hanger in a wellhead. Various embodiments may include landing a hanger in a wellhead, performing a cementing operation, and directing mud through one or more flow-by paths prior to landing a lock ring and seal assembly above a debris pocket. Systems and methods may enable a seal and lock ring to land above a debris pocket, which can accommodate cuttings and well debris that may stagnant, such as after cleaning and flushing operations in the well. In at least one embodiment, the lock down rings are below a seal that is run with a packoff and landed on a hanger with a debris pocket below. Once engaged, the lock ring may remain as part of the hanger for future operations, such as replacing the seal, and retrieval. However, it should be appreciated that the lock ring may not remain as part of the hanger in various embodiments.

Systems and methods of the present disclosure may enable simplified operational tools. By way of example, configurations disclosed herein may enable the hanger to be locked down with improved debris tolerance and seal installation reliability. Moreover, embodiments provide for the tubing hanger position to be locked down prior to landing the seal, which may provide advantages for downhole completions operations such as setting and testing packers.

Various embodiments are directed toward a debris pocket that is formed between a hanger and a housing. The debris pocket may be positioned below an auxiliary shoulder on the hanger. The configuration and position of the debris pocket may allow for debris to passively fall away from the auxiliary shoulder, or enable flushing operations to wash any debris away from the lock down and seal packoff area so that the seal can be reliably set.

Embodiments of the present disclosure may overcome problems and drawbacks with existing systems where debris accumulation in an annulus area between a hanger neck and a wellhead housing my cause difficulties with wellhead construction. Debris can be from cuttings, such as during drilling operations, or metal swarf from casing milling operations. As the mud returns through flow-by paths from the casing annulus during cementing operations, the cuttings are displaced out of the annulus between the drilled hole and the casing string. When the cementing operations are completed, the cuttings that are suspended in the mud column above the hanger, but below the rig floor, may fall and stagnate in the annulus area. This debris can affect the installation of the hanger lock down and annulus packoff by restricting movement and blocking the defined landing position of such components. Moreover, after landing the hanger and prior to landing a seal, operators may run a clean and flush operation around the hanger neck to flush any debris down and away from the seal landing area. With conventional hangers, where the lock ring is run with the hanger body, this may cause the debris to be flushed down and into the hanger lock ring pocket and grooves, which can restrict the installation of such lock rings, leading to non-productive time and often a shutdown of operations.

Systems and methods overcome the problems of existing systems by allowing the hanger landing, cementing, and flushing operations to be carried out prior to the landing of the lock down components and the seal. Moreover, geometries of components of the present embodiments create a debris pocket to accommodate debris between the housing and the hanger, with a route to escape back down through the hanger flow-by holes/slots. In at least one embodiment, the debris pocket is formed as an annulus area between the hanger and the housing, which sits below an auxiliary shoulder on the hanger neck, and allows for debris to be washed by, prior to landing the lock down components. Various embodiments include lock down components having a landing pedestal, which interfaces with the hanger auxiliary shoulder and supports the lock ring during operation, and the lock ring that interfaces with the housing. During operation, the hanger force from below is transferred through the auxiliary shoulder, into the pedestal, through the lock ring, and into the housing. Furthermore, the lock down components may be run with the packoff assembly, or run as a separate lock down sub-assembly. The lock down components may be run into the annulus above the debris pocket and be energized during the setting of the seal above. Additionally, the lock down ring and pedestal may stay with the hanger body for the life of the well to be recovered as part of the hanger.

Various embodiments of the present disclosure provide advantages over existing methods by locking the hanger down from below the seal. Such operation allows the hanger neck length to shrink relative to a system that locks the hanger down from above the seal. It also allows the full thickness of the hanger neck above the packoff to take the compression load from any subsequent hangers that may land above. That is to say that the top of the hanger neck may not be cut to accommodate a shoulder ring that would transfer the lock down force from below, through the hanger neck and into the lock down components to the housing. As a result, systems may be utilized in lower pressure wellbores with different size considerations by shrinking the system. Moreover, costs may be saved by reducing material use.

FIG. 1 is a side schematic view of an embodiment of a subsea drilling operation 100. It should be appreciated that one or more features have been removed for clarity with the present discussion and that removal or inclusion of certain features is not intended to be limited, but provided by way of example only. Furthermore, while the illustrated embodiment describes a subsea drilling operation, it should be appreciated that one or more similar processes may be utilized for surface applications and, in various embodiments, similar arrangements or substantially similar arrangements described herein may also be used in surface applications. The drilling operation includes a vessel 102 floating on a sea surface 104 substantially above a wellbore 106. As noted, the vessel 102 is for illustrative purposes only and systems and methods may further be illustrated with other structures, such as floating/fixed platforms, and the like. A wellbore housing 108 sits at the top of the wellbore 106 and is connected to a blowout preventer (BOP) assembly 110, which may include shear rams 112, sealing rams 114, and/or an annular ram 116. One purpose of the BOP assembly 110 is to help control pressure in the wellbore 106. The BOP assembly 110 is connected to the vessel 102 by a riser 118. During drilling operations, a drill string 120 passes from a rig 122 on the vessel 102, through the riser 118, through the BOP assembly 110, through the wellhead housing 108, and into the wellbore 106. It should be appreciated that reference to the vessel 102 is for illustrative purposes only and that the vessel may be replaced with a floating/fixed platform or other structure. The lower end of the drill string 120 is attached to a drill bit 124 that extends the wellbore 106 as the drill string 120 turns. Additional features shown in FIG. 1 include a mud pump 126 with mud lines 128 connecting the mud pump 126 to the BOP assembly 110, and a mud return line 130 connecting the mud pump 126 to the vessel 102. A remotely operated vehicle (ROV) 132 can be used to make adjustments to, repair, or replace equipment as necessary. Although a BOP assembly 110 is shown in the figures, the wellhead housing 104 could be attached to other well equipment as well, including, for example, a tree, a spool, a manifold, or another valve or completion assembly.

One efficient way to start drilling a wellbore 106 is through use of a suction pile 134. Such a procedure is accomplished by attaching the wellhead housing 108 to the top of the suction pile 134 and lowering the suction pile 134 to a sea floor 136. As interior chambers in the suction pile 134 are evacuated, the suction pile 134 is driven into the sea floor 136, as shown in FIG. 1, until the suction pile 134 is substantially submerged in the sea floor 136 and the wellhead housing 108 is positioned at the sea floor 136 so that further drilling can commence. As the wellbore 106 is drilled, the walls of the wellbore are reinforced with concrete casings 138 that provide stability to the wellbore 106 and help to control pressure from the formation. It should be appreciated that this describes one example of a portion of a subsea drilling operation and may be omitted in various embodiments. In at least one embodiment, systems and methods of the present disclosure may be used for drilling operations that are completed through a BOP and wellhead, where a casing hanger and string are landed in succession. As noted above, configurations with respect to a sea floor or any offshore application are for illustrative purposes and embodiments of the present disclosure may also be utilized in surface drilling applications.

Figure 2:
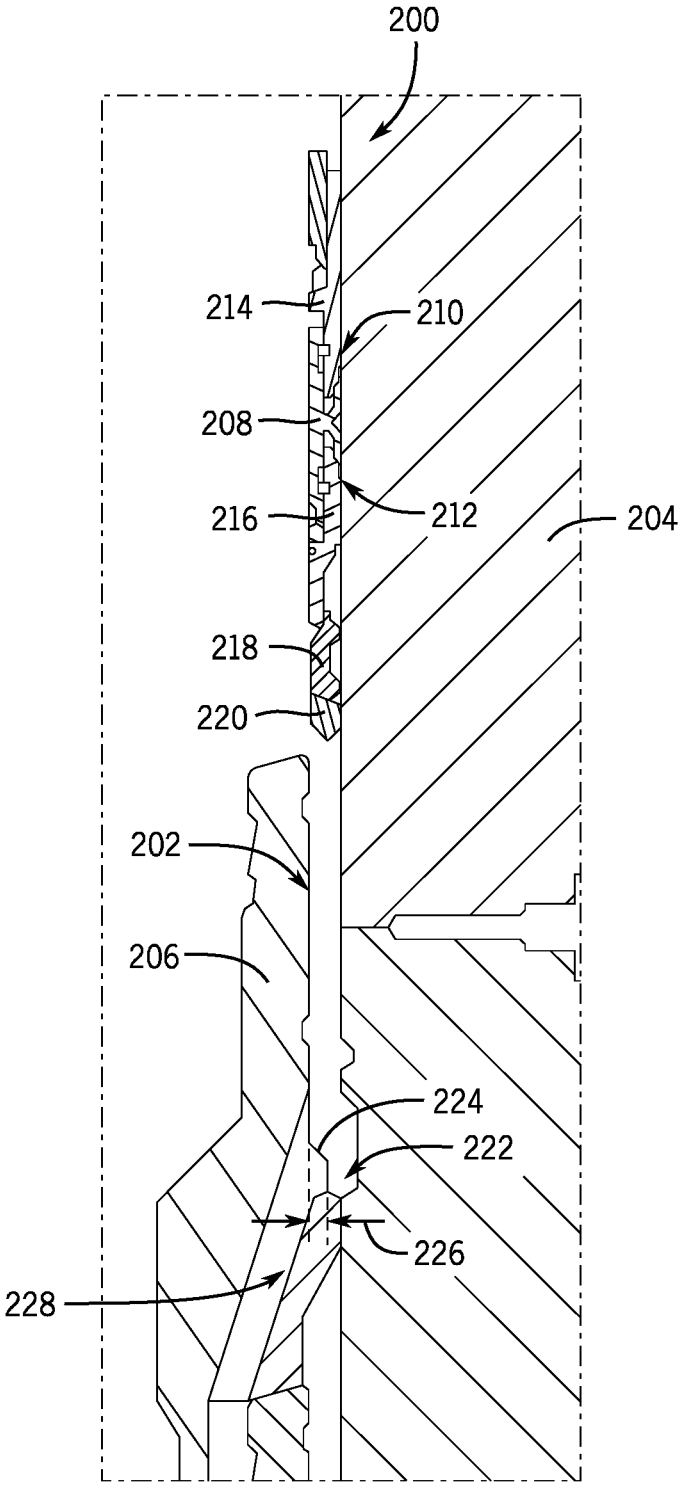
FIG. 2 is a cross-sectional view of an embodiment of a sealing assembly, in accordance with embodiments of the present disclosure.

FIG. 2 is a cross-sectional view of an embodiment of a sealing assembly 200 (e.g., a packoff, an annulus packoff, a sealing system, etc.). It should be appreciated that the system 200 may include more or fewer components, and certain components have been eliminated for simplicity with the following discussion. The sealing assembly 200 may include one or more features, as will be described below, in order to form a pressure barrier within a wellbore. In this example, the sealing assembly 200 may include one or more annular components, which may also be segmented, split, etc. in order to be positioned within an annulus 202 (e.g., annular space) formed between a housing 204 (e.g., a wellhead housing) and a hanger 206.

The sealing assembly 200 includes a sealing element 208 (e.g., a seal), which is shown as a seal having an upper opening 210 and a lower opening 212. It should be appreciated that such a seal is shown for illustrative purposes only and is not intended to limit the scope of the present disclosure. For example, a variety of different types of annular seals (e.g., U-seals, H-seals, etc.) may be utilized with embodiments of the present disclosure. In this configuration, an upper energizing ring 214 (E-ring) is used to activate the sealing element 208 at the upper opening 210 and a lower energizing ring 216 is used to activate the sealing element 208 at the lower opening 212. That is, one or more forces may drive the respective E-rings 214, 216 into the openings 210, 212 to drive legs of the sealing element 208 apart such that an inner leg (e.g., radially inner) is driven into the hanger 206 and an outer leg (e.g., radially outer) is driven into the housing 204 to form a seal within the annulus 202. As noted above, different E-rings may be used based on the type of sealing element 208 selected for operations.

A lock ring 218 is coupled to the lower E-ring 216 and is arranged below the sealing element (e.g., axially lower than the sealing element, in a position such that the lock ring 218 enters the wellbore prior to the sealing element). The lock ring 218 may also be coupled to one or more additional or alternative elements, but due to the sealing element 208 shown in FIG. 2, the locking ring 218 is coupled to the lower E-ring 216. In this example, at least a portion of the lock ring 218 overlaps at least of a portion of the lower E-ring 216 radially. That is, a portion of the lock ring 218 is arranged radially between the lower E-ring 216 and the housing 204. It should be appreciated that various configurations may be utilized where such an overlap is not present, such as coupling the lock ring 218 to a bottom surface or plane of the lower E-ring 216, as one example.

The lock ring 218 may be removably coupled to the lower E-ring 216 via one or more retention mechanisms. For example, the lock ring 218 may be coupled to the lower E-ring 216 such that the lock ring 218 is decoupled from the lower E-ring 216 responsive to one or more forces or movements of the lower E-ring 216. In other words, the lock ring 218 may be coupled to the lower E-ring 216 such that the lock ring 218 decouples from the lower E-ring 216 approximately when the lock ring 218 and/or the sealing element 208 is energized. The retention mechanism may include one or more of fasteners, such as shear pins or shear screws, dogs, lips, clips, or the like.

The lock ring 218 is positioned to extend axially away from the lower E-ring 216 such that the lock ring 218 is shown axially lower and extending axially farther into the wellbore than the lower E-ring 216. A pedestal 220 is coupled to the lock ring 218 and is arranged axially lower than and farther into the wellbore than the lock ring 218. In at least one embodiment, one or more coupling elements join the pedestal 220 to the lock ring 218, such as one or more pins, screws, clips, or the like. In at least one embodiment, the pedestal 220 is a substantially solid component formed in an annual shape, as opposed to the lock ring 218 which may be split or segmented. However, it should be appreciated that the pedestal 220 may also be split or segmented in various embodiments. In such a configuration, the pedestal 220 may include a variety of different couplings in order to maintain a position of the pedestal 220 with respect to different segments or portions of the lock ring 218.

The configuration of FIG. 2 illustrates the sealing assembly 200 prior to installation within the annulus 202. As a result, one or more operations may have been previously conducted within the wellbore prior to installation of the sealing assembly 200, such as a cementing operation, a mill and flush, a clean and flush, or various other operations. As a result, debris (not pictured) may be arranged within the annulus 202 and may gather in a debris pocket 222. The pocket 222 may be formed, at least in part, within the annulus 202 by respective profiles of the housing 204 and the hanger 206. For example, at least a portion of the pocket 222 may be formed by an auxiliary shoulder 224 that is positioned to receive and support the pedestal 220, as will be described below. In this example, the shoulder 224 extends radially outwardly toward the housing 204 and has a shoulder thickness 226. Such a configuration provides a larger outer diameter proximate the auxiliary shoulder 224 than at other locations of the hanger 206, such as along a sealing surface. In other words, the shoulder thickness 226 represents an additional outward extension of the hanger 206 relative to a region of the hanger 206 axially higher than the shoulder 224.

Various embodiments may further include flow-by paths 228 (e.g., flow-by passages, slots, or holes) associated with the hanger 206. The flow-by paths 228 having openings arranged proximate the pocket 222 such that debris that is driven into the pocket 222, such as during a wash operation, may be directed into the flow-by paths 228 and removed from the pocket 222.

In various embodiments, the pedestal 220 may serve as a separate component that is not integrally formed with or a part of the hanger 206. For example, various traditional components may include an extended auxiliary shoulder 224 that supports a lock ring during radial outward expansion into a housing lock ring groove. However, this creates significant problems associated with debris collection and removal. For example, the auxiliary shoulder may have dimensions that permit application of a force to a lock ring. If the auxiliary shoulder extends too far radially outward, it may block downward movement of debris. Moreover, in an effort to provide sufficient force transfer, an angle of the shoulder may be relatively shallow, which does not facilitate movement of debris that may collect along the shoulder. Debris collection along the shoulder may cause debris to enter a lock ring groove formed in the housing 204. Additionally, it should be noted that a large auxiliary shoulder may also interfere with flushing operations. Embodiments of the present disclosure overcome these problems by separating the pedestal 220 from the hanger 206. In this manner, the sealing assembly 200 may not be in the wellbore during various operations, such as flushing. Accordingly, a larger opening into the debris pocket 222 is formed during a flushing operation. Additionally, the auxiliary shoulder 224 may have a more severe angle, thereby driving collected debris off and toward the debris pocket 222 passively or during flushing operations.

As will be further described, embodiments of the present disclosure enable the formation of the debris pocket 222 in an axially lower position than one or more lock ring grooves formed in the housing 204. In at least one embodiment, the auxiliary shoulder 224 is sized such that debris may wash off the shoulder 224 prior to installation of the sealing assembly 200 so that the debris flows into the debris pocket 222. Additionally, embodiments may be directed toward one or more annular packoffs that may be set from below or from above. Furthermore, various embodiments include one or more lock rings 218 that are at least one of split, segmented, or the like. Additionally, in embodiments, the pedestal 220 may be solid, split, segmented, or the like.

Figure 3:
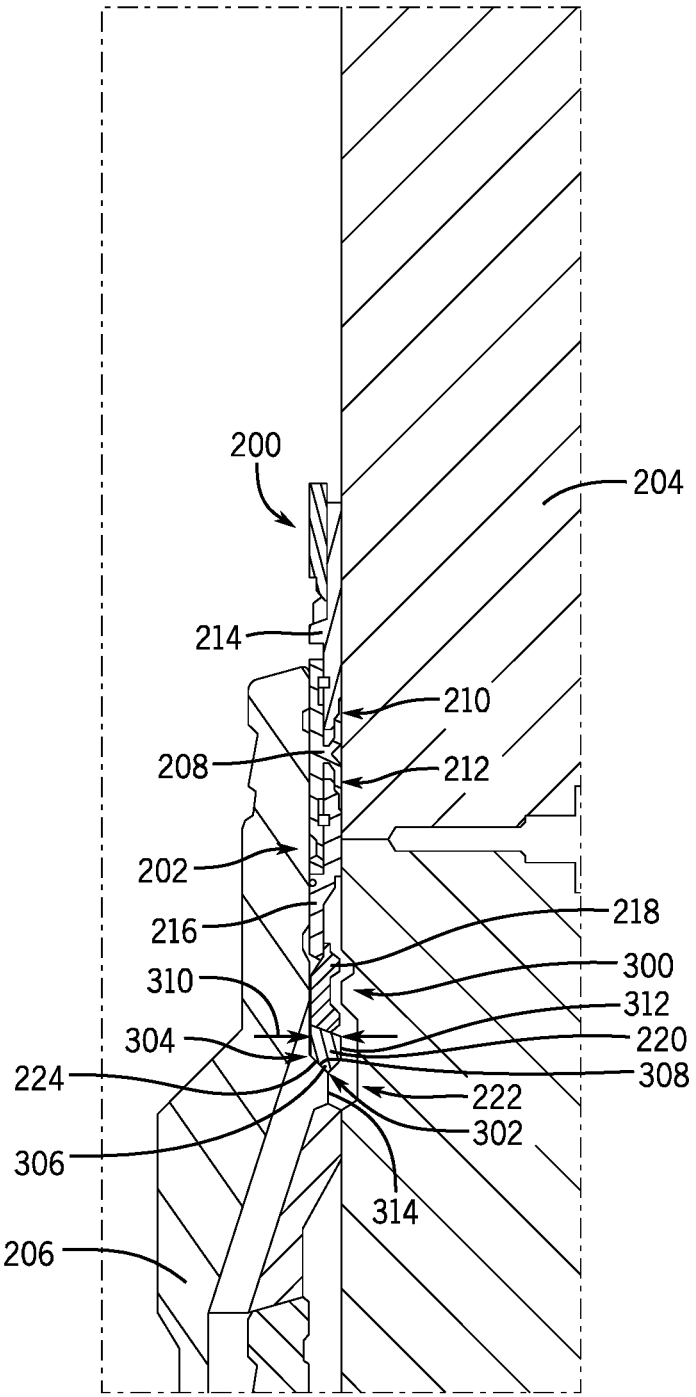
FIG. 3 is a cross-sectional view of an embodiment of a sealing assembly, in accordance with embodiments of the present disclosure.

FIG. 3 is a cross-sectional view of an embodiment of the sealing assembly 200 where the sealing assembly is lowered into annulus 202. In this example, at least a portion of the sealing assembly 200 is driven into the annulus 202 such that the sealing element 208 is arranged proximate one or more sealing surfaces of the housing 204 and/or the hanger 206. It should be appreciated that the sealing element 208 is not in a set or engaged position in FIG. 3, as shown by the position of the E-rings 214, 216 with respect to the openings 210, 212.

As the sealing assembly 200 is moved into the annulus 202, the pedestal 220 is brought into contact with the auxiliary shoulder 224. As shown, the geometry of the pedestal 220 positions the lock ring 218 proximate a lock ring groove 300, which receives the lock ring 218 upon activation of the lock ring 218 and/or the sealing element 208. It should be appreciated that a profile 302 of the auxiliary shoulder 224 may be substantially similar to a profile 304 of the pedestal 220. For example, a shoulder slanted surface 306 may substantially conform to a pedestal lower surface 308. In at least one embodiment, the relative angles of these surfaces 306, 308 are particularly selected based on operating conditions, and moreover, may be selected to encourage any debris that collects on the auxiliary shoulder 224 to fall down and into the pocket 222.

As shown in FIG. 3, a pedestal thickness 310 positions an outer edge 312 of the pedestal 220 closer to the housing 204 than an outer edge 314 of the auxiliary shoulder 224. That is, in various embodiments, the pedestal thickness 310 may be greater than the shoulder thickness 226. While this configuration may reduce an entrance to the debris pocket 222, as explained, various operations associated with debris may have already completed prior to installation of the sealing assembly 200. As a result, by running the pedestal 220 in with the sealing assembly 200, rather than having the pedestal 220 be integral with the hanger 206, a larger entrance is enabled when in use and then benefits of the pedestal 220, such as its positioned relative to the lock ring groove 300, top surface angle, etc. may still be realized with embodiments of the present disclosure.

The illustrated configuration still provides a pathway into the pocket 222 in the event additional debris is dislodged or otherwise drawn into the annulus 202. By moving debris to the pocket 222, one or more sealing interfaces will be less likely to be damaged or distorted, which may increase a likelihood of error during a setting process. Furthermore, debris may be less likely to cause misalignment, obstruct energization of annulus components, or other errors during the setting process.

Figure 4:
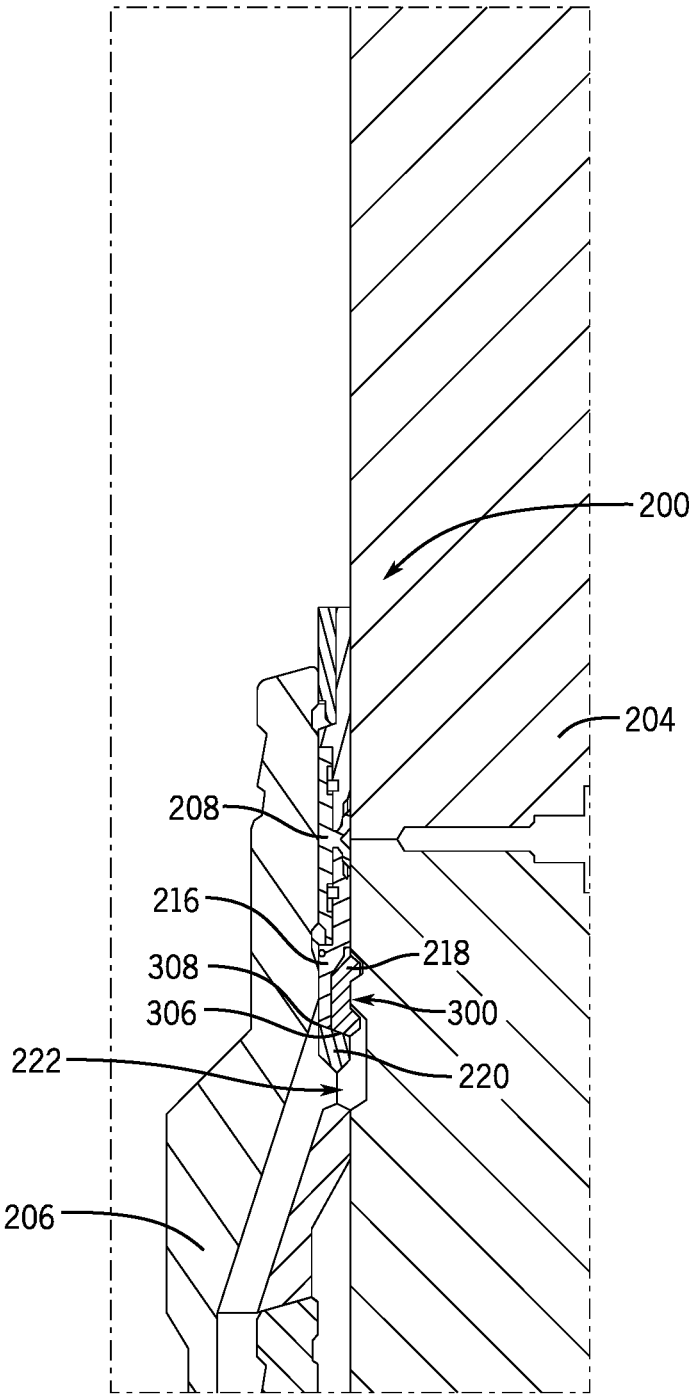
FIG. 4 is a cross-sectional view of an embodiment of a sealing assembly, in accordance with embodiments of the present disclosure.

FIG. 4 is a cross-sectional view of an embodiment of the sealing assembly 200 in an activated position such that the sealing element 208 is set and the lock ring 218 is driven into the lock ring groove 300. As shown, a downward movement of the lower E-ring 216 applies a force to the lock ring 218, driving the lock ring 218 radially outward and toward the lock ring groove 300. The lock ring 218 may slide or otherwise shift along the pedestal 220, for example at the interface between the respective surfaces 306, 308. In this example, when compared to the configuration of FIG. 3, it can be seen that the lock ring 218 has moved radially outward and down along the surface 306, which forms a gap between the lock ring 218 and the hanger 206 to receive the lower E-ring 216. Furthermore, in this example, the lower E-ring 216 may be driven in a downward direction to engage the pedestal 220, for example, due to a force. It should be appreciated that in other embodiments an upward forward may be applied by the pedestal 220. The pocket 222 remains clear of components associated with the sealing assembly 200 to clear or otherwise maintain debris out of contact with moving or sealing surfaces for setting the packoff in the wellbore. Downhole operations may now continue with a set hanger 206. In this embodiment the sealing assembly 200 may be sequentially set, with the lock ring 218 set first, prior to setting the seal element 208. In this embodiment, the interface between the lower E-ring 216 and the pedestal 220 forms the reaction point for setting the seal element 208. Whereby the upper E-ring 214 is used to activate the sealing element 208 at the upper opening 210 and the lower E-ring 216 is used to activate the sealing element 208 at the lower opening 212.

Figure 5:
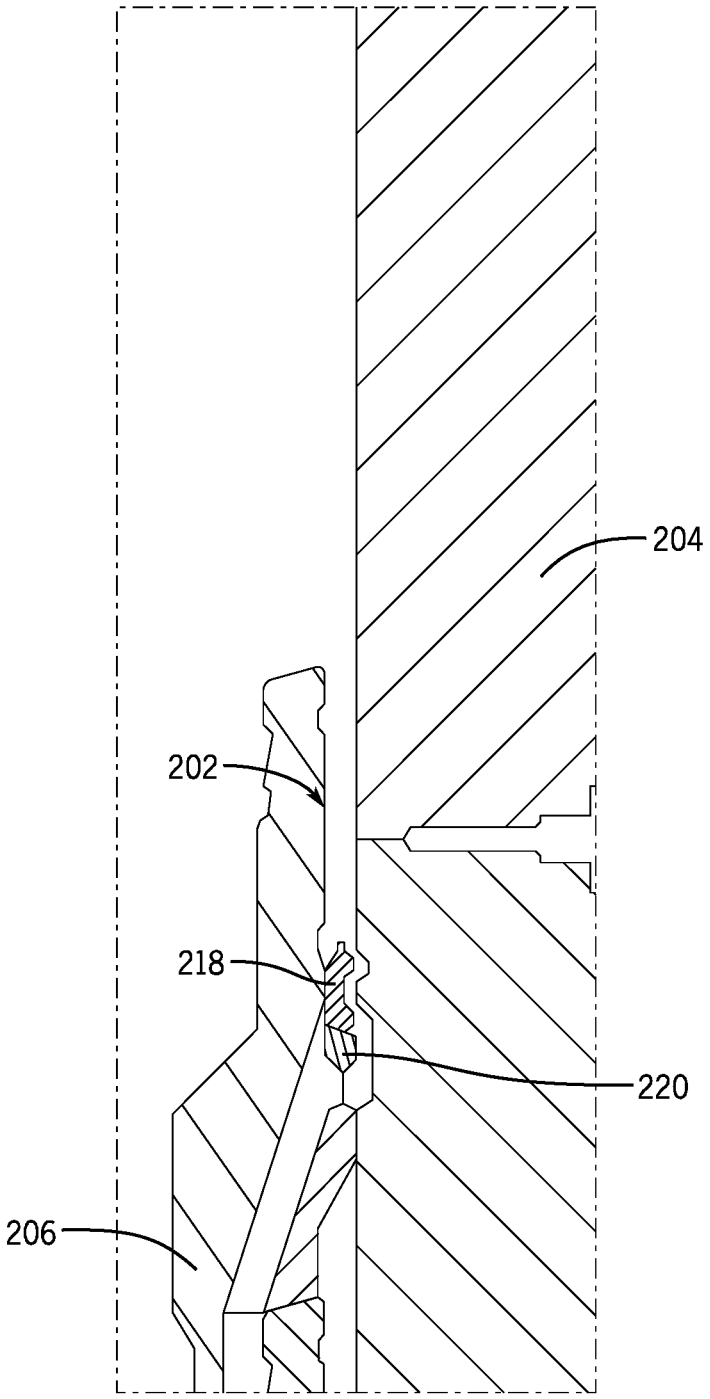
FIG. 5 is a cross-sectional view of an embodiment of a lock ring and pedestal, in accordance with embodiments of the present disclosure.

FIG. 5 is a cross-sectional view of an embodiment of the lock ring 218 and pedestal 220 remaining within the annulus 202 after removal of the remainder of the seal assembly 200, such as the sealing element 208 and associated components. In this example, the sealing element 208 has been de-energized and removed from the wellbore. However, as noted above, the connection between the lock ring 218 and the sealing element 208 may be broken or severed when the sealing element 208 is energized, and as a result, the components no longer move as a singular piece. Accordingly, the lock ring 218 and associated pedestal 220 may remain in the annulus 202 to be removed with the hanger 206. Additionally, in at least one embodiment, the lock ring 218 may be reused with future seals. In various embodiments, the lock ring may be an inward biased split C-ring. When the radial support of the lower E-ring 216 is removed from the expanded lock ring 218, the lock ring 218 retracts radially inward to its relaxed natural state (biased toward the hanger 206).

As illustrated, FIGS. 2-5 may illustrate a sequence corresponding to installation and removal of at least a portion of the sealing assembly. In FIG. 2, the sealing assembly 200 is not within the annulus 202 and is being run into the wellbore. The annulus 202 may have undergone one or more previous operations, such as a flushing operation, where debris is washed into the debris pocket 222, which is positioned axially lower than the auxiliary shoulder 224 and axially lower than the lock ring groove 300. In this manner, the shoulder 224 may be free or substantially free of debris and there may be a reduced likelihood that debris has washed into the lock ring groove 300. FIG. 3 illustrates initial installation of the sealing assembly 200 where the pedestal 220 is run down and into contact with the auxiliary shoulder 224. In this example, the pedestal 220 extends radially further in an outward direction toward the housing 204 than the auxiliary shoulder 224. As noted above, by adding the pedestal 220 after the cementing and flushing operations, an opening for the debris pocket 222 may be larger and, moreover, may be axially lower with respect to the lock ring groove 300 to reduce a likelihood of debris being washed into the lock ring groove 300. FIG. 4 illustrates activation of the seal assembly 200 where the lock ring 218 is driven radially outward and into the lock ring groove 300. FIG. 5 then illustrate deactivation of the sealing element 208 and removal of portions of the sealing assembly, but the lock ring 218 and the pedestal 220 have been left within the wellbore.

Figure 6B:
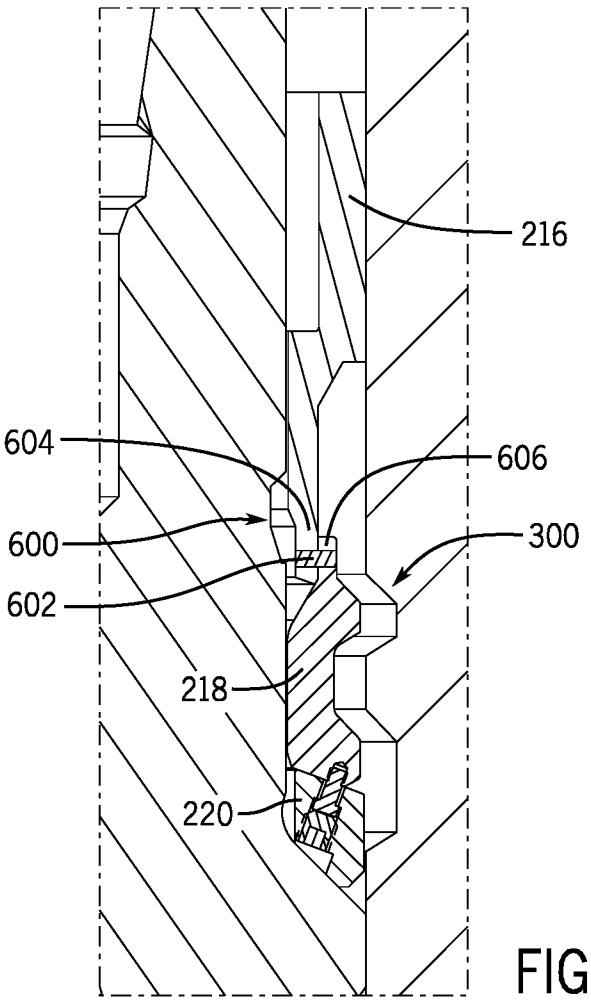
FIGS. 6A and 6B are cross-sectional views of embodiments of a retention system, in accordance with embodiments of the present disclosure.
Figure 6A:
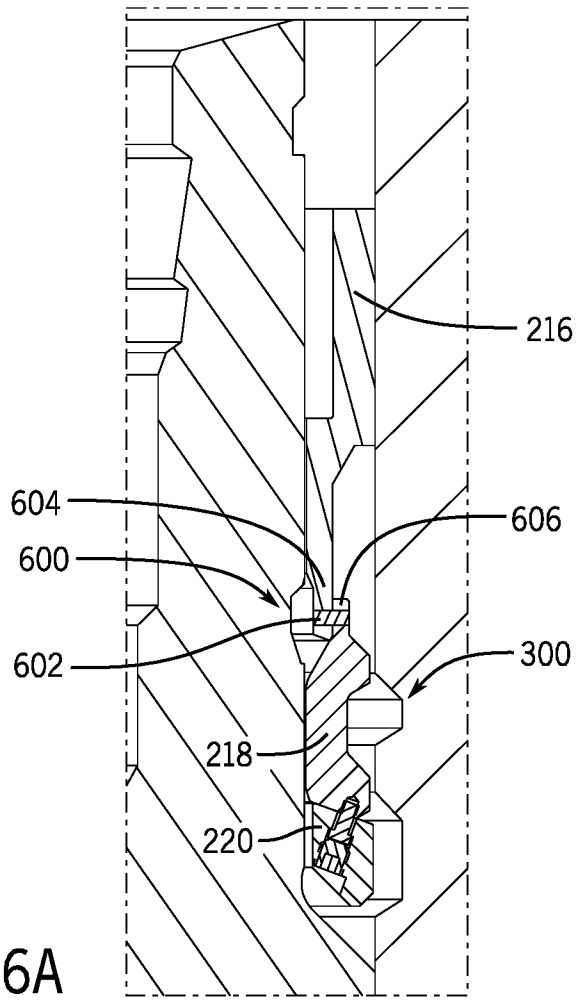

FIGS. 6A and 6B are cross-sectional views of an embodiment of a retention system 600 to secure the lower E-ring 216 to the lock ring 218. In this example, lock ring 218 is coupled to the lower E-ring 216 via one or more fasteners 602 (e.g., pins). It should be appreciated that pins 602 are shown by way of example only and that additional and/or alternative fastening mechanisms may be utilized, such as screws, slots, clamps, dogs, and the like. In operation, as the lock ring 218 is energized the lower E-ring 216 slides in a downward direction toward the pedestal 220, thereby shearing the pins 602 to release the lock ring 218.

In this example, the pins 602 extend through a lower extension 604 of the lower E-ring 216 and an upper extension 606 of the lock ring 218. As a result, the pins 602 are arranged substantially horizontally (e.g., extending in a radial direction). It should be appreciated that such a configuration is for illustrative purposes only and embodiments of the present disclosure may include additional or alternative coupling mechanisms. For example, the pins 602 may be in a substantially vertical or angled orientation. Furthermore, additional areas of the lower E-ring 216 and/or the lock ring 218 may also be coupled together. Moreover, it should be appreciated that a number of pins 602 used may vary based, at least in part, on a configuration of the lower E-ring 216 and the lock ring 218. For example, a segmented ring 218 may include pins at each segment.

Figure 7:
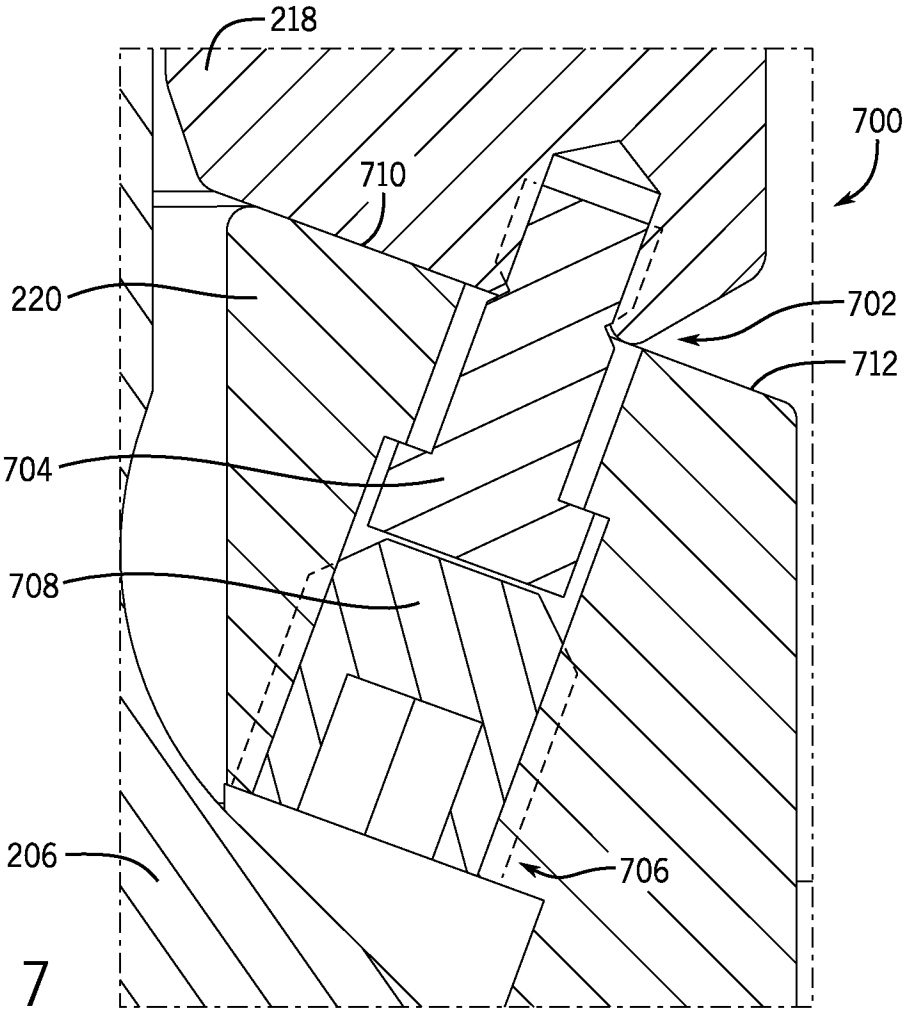
FIG. 7 is a cross-sectional view of an embodiment of a coupling interface, in accordance with embodiments of the present disclosure.

FIG. 7 is a cross-sectional view of an embodiment of a coupling interface 700 between the pedestal 220 and the lock ring 218. In this example, a fastening system 702 is utilized to join the pedestal 220 to the lock ring 218 such that the pedestal 220 and the lock ring 218 may be movable with respect to one another. As shown in FIG. 7, by way of non-limiting example, pedestal 220 is retained to the lock ring 218 via a series of fasteners 704 (e.g., shear screws). The shear screws 704 are shown to be threaded through a counter sunk hole 706 and into the lock ring 218. In this example, the fasteners 704 are retained by one or more retention members 708 (e.g., set screws or snap rings) to hold the fasteners 704 in place after shearing.

In operation, the fasteners 704 hold the pedestal 220 to the lock ring 218 during installation, such as when the lock ring 218 is in a retracted position. In this example, the lock ring 218 is relaxed in the inward biased position (e.g., biased toward the hanger 206). As the lock ring 218 is energized (e.g., driven radially outward toward the housing 204) a lock ring surface 710 slides along a pedestal surface 712 and creates a shear force. This force shears the fastener 704. The lock ring piece is retained to the lock ring 218 via a threaded interface, in this example. The pedestal piece is retained in by the counter sunk shoulder and the retainer 708.

Figure 8A:
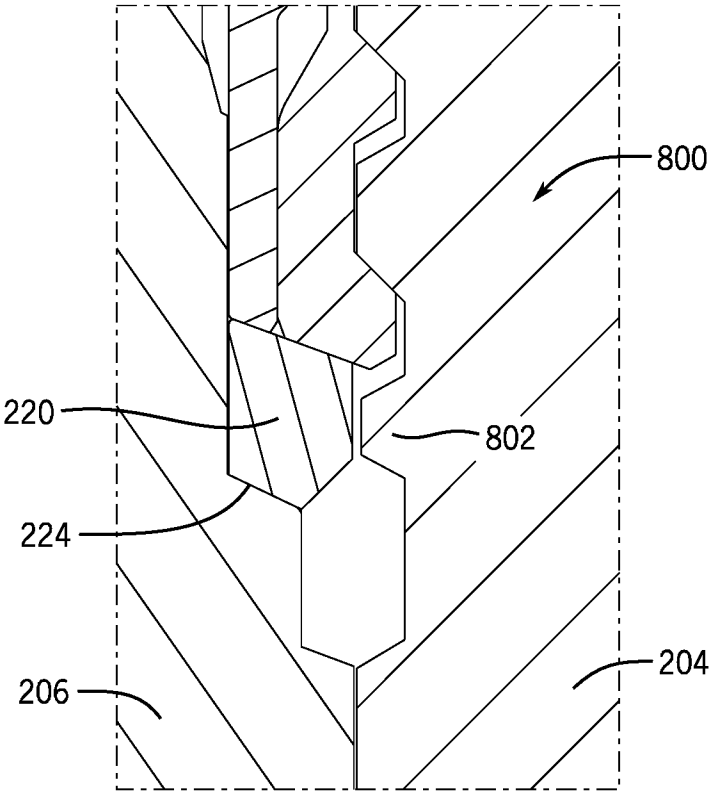
FIGS. 8A-8C are cross-sectional views of embodiments of interface configurations, in accordance with embodiments of the present disclosure.
Figure 8B:
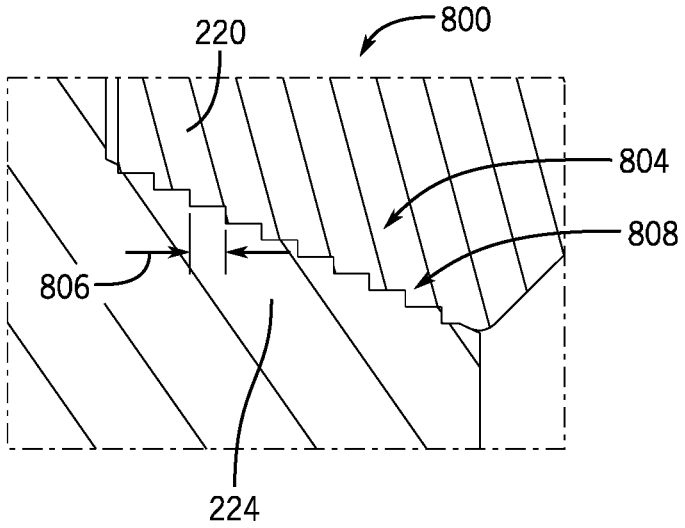
Figure 8C:
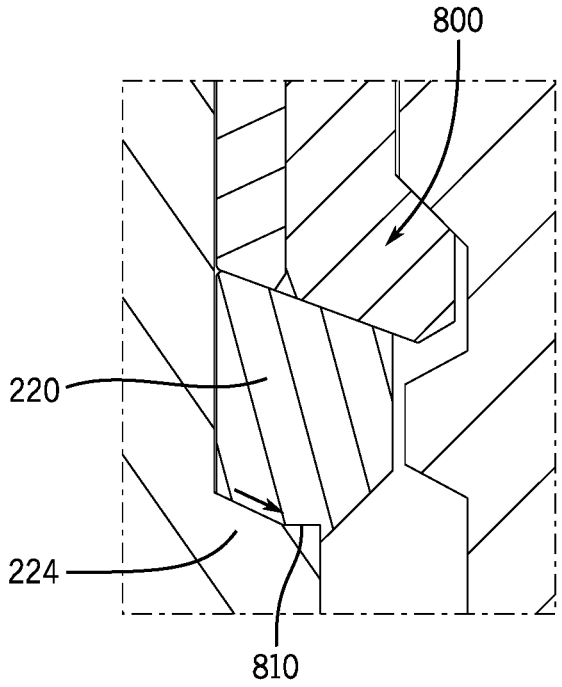

FIGS. 8A-8C are schematic cross-sectional views of embodiments of hanger interface configurations 800 that may be used with embodiments of the present disclosure. As noted above, in various embodiments, one or more profiles or geometries may be particularly selected to facilitate wellbore operations with respect to the pedestal 220 and the auxiliary shoulder 224. FIG. 8A, for example, illustrates a lug 802, which may be part of a series of lugs, that act as a radial support to limit the radial deflection of the pedestal 220 under load. That is, the lugs 802 extend radially inward from the housing 204 to block movement of the pedestal 220 beyond a certain point. As noted above, due to the pedestal 220 being installed after various operations, such as a flushing operation, including the lugs 802 still permits access to the debris pocket 222, for example, by placing the lugs 802 radially higher than the auxiliary shoulder 224. In at least one embodiment, the lugs 802 may be located between milled slots.

FIG. 8B illustrates a stepped surface 804 to permit debris larger than a width 806 of the steps 808 to roll along the surface 804, but prevents any radial force component from causing the pedestal 220 to flare out. FIG. 8C illustrates a horizontal surface 810 that creates an obstruction to the load surface to prevent the pedestal 220 from flaring out under load.

The foregoing disclosure and description of the disclosed embodiments is illustrative and explanatory of the embodiments of the invention. Various changes in the details of the illustrated embodiments can be made within the scope of the appended claims without departing from the true spirit of the disclosure. The embodiments of the present disclosure should only be limited by the following claims and their legal equivalents.

The invention claimed is:

1. A wellbore system, comprising:

a lock ring groove formed in a housing;

a lock ring to be positioned within an annulus between a hanger and the housing, the lock ring being movable to engage the lock ring groove after the lock ring is activated;

a pedestal coupled to the lock ring, the pedestal arranged axially lower than at least a portion of the lock ring, the pedestal to be installed within the annulus along with the lock ring, and wherein the pedestal and the lock ring are configured to be run into the annulus on a single trip with a sealing assembly;

a shoulder formed on at least a portion of the hanger, the shoulder positioned to receive the pedestal; and a debris pocket formed within the annulus, the debris pocket arranged axially lower than both the shoulder and the lock ring groove.

2. The wellbore system of claim 1, wherein the lock ring is removably coupled to the sealing assembly.

3. The wellbore system of claim 1, wherein the pedestal is removably coupled to the lock ring.

4. The wellbore system of claim 1, wherein an outer edge of the pedestal extends farther in a radially outward direction than an outer edge of the shoulder after the pedestal is positioned on the shoulder.

5. The wellbore system of claim 1, further comprising:

a flow-by passage associated with the debris pocket, an entrance to the flow-by passage formed in the debris pocket and positioned axially lower than the shoulder.

6. The wellbore system of claim 1, wherein the shoulder includes a shoulder surface, the shoulder surface arranged at an angle such that the shoulder surface is slanted in a downward direction toward the debris pocket.

7. The wellbore system of claim 6, wherein the angle is selected to permit passive movement of debris into the debris pocket.

8. The wellbore system of claim 1, further comprising:

one or more interface configurations to restrict radial movement of the pedestal.

9. A wellbore system, comprising:

a housing having a lock ring groove;

a hanger arranged coaxially within the housing, the hanger having an auxiliary shoulder positioned axially lower than at least a portion of the lock ring groove;

a sealing assembly, comprising:

a sealing element configured to be positioned between the housing and the hanger; and an energizing element configured to drive legs of the sealing element against at least one of the housing or the hanger;

a lock ring coupled to and axially lower than at least one of the sealing element or the energizing element, the lock ring configured to move radially toward the lock ring groove to secure the hanger in an energized position;

a pedestal coupled to the lock ring to be transported into a wellbore after the hanger is positioned in the wellbore, a bottom surface of the pedestal being axially lower than the lock ring such that the pedestal is positioned between the lock ring and the auxiliary shoulder; and a debris pocket formed between the hanger and the housing, the debris pocket being axially lower than the lock ring groove and the auxiliary shoulder.

10. The wellbore system of claim 9, wherein the lock ring is removably coupled to the at least one of the sealing element or the energizing element via one or more pins.

11. The wellbore system of claim 9, wherein the pedestal is removably coupled to the lock ring via one or more fasteners.

12. The wellbore system of claim 9, wherein both the lock ring and the pedestal are configured to remain within a wellbore after the sealing assembly is retrieved.

13. The wellbore system of claim 9, wherein the auxiliary shoulder includes a downwardly slanted surface that corresponds to a profile of the pedestal.

14. The wellbore system of claim 9, wherein an entrance to the debris pocket is larger prior to installation of the pedestal.

15. The wellbore system of claim 9, wherein the lock ring is configured to be run into the wellbore with the pedestal.

16. The wellbore system of claim 9, wherein the lock ring is at least one of a split ring, or a segmented ring.

17. A method, comprising:

providing a hanger having an auxiliary shoulder, the auxiliary shoulder having a larger outer diameter than a neck of the hanger;

positioning the hanger within a housing such that the auxiliary shoulder is axially lower than at least a portion of a lock ring groove;

running a sealing assembly into an annulus between the hanger and housing, the sealing assembly including a lock ring and a pedestal being run with the sealing assembly after both the hanger and the housing are positioned within a wellbore;

positioning the pedestal on the auxiliary shoulder, the pedestal reducing an opening area for a debris pocket formed axially lower than the auxiliary shoulder; and energizing the sealing assembly such that the lock ring is driven into the lock ring groove.

18. The method of claim 17, further comprising:

performing a cementing, cleaning, or flushing operation within the annulus prior to installing the sealing assembly.

19. The method of claim 17, further comprising:

retrieving a portion of the sealing assembly such that the lock ring and the pedestal remain within the annulus.

* * * * *